US011448175B1

(12) United States Patent
Overman

(10) Patent No.: US 11,448,175 B1
(45) Date of Patent: Sep. 20, 2022

(54) FUEL NOZZLE

(71) Applicant: General Electric Company, Schenectady, NY (US)

(72) Inventor: Nicholas R. Overman, Sharonville, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/337,886

(22) Filed: Jun. 3, 2021

(51) Int. Cl.

| | |
|---|---|
| ***F02M 61/18*** | (2006.01) |
| ***F02M 45/08*** | (2006.01) |
| ***F02M 63/02*** | (2006.01) |
| ***F02M 21/02*** | (2006.01) |

(52) U.S. Cl.
CPC .... *F02M 61/1813* (2013.01); *F02M 21/0248* (2013.01); *F02M 45/086* (2013.01); *F02M 63/02* (2013.01); *F02M 2200/44* (2013.01)

(58) Field of Classification Search
CPC ..... F02M 61/1813; F02M 21/0248; F02M 45/086; F02M 63/02; F02M 2200/44
See application file for complete search history.

(56) References Cited

U.S. PATENT DOCUMENTS

| | | | | |
|---|---|---|---|---|
| 3,154,095 | A | 10/1964 | Cleminshaw et al. | |
| 4,022,165 | A | 5/1977 | Eckert et al. | |
| 4,726,396 | A * | 2/1988 | Bradley | F02C 9/263 137/541 |
| 6,422,199 | B1 | 7/2002 | Buckley et al. | |
| 7,556,017 | B2 | 7/2009 | Gibson | |
| 9,206,778 | B2 | 12/2015 | Kim et al. | |
| 10,767,610 | B2 | 9/2020 | Anders et al. | |
| 2003/0066509 | A1 * | 4/2003 | Shafer | F02M 61/161 123/305 |
| 2012/0312890 | A1 * | 12/2012 | Romig | F23R 3/286 239/5 |
| 2015/0276225 | A1 * | 10/2015 | Kapilavai | F23R 3/286 60/737 |
| 2020/0063704 | A1 * | 2/2020 | Anders | F02M 61/1826 |

FOREIGN PATENT DOCUMENTS

| | | | | |
|---|---|---|---|---|
| CN | 103930723 A | * | 7/2014 | F23R 3/343 |
| CN | 105464865 B | | 11/2017 | |
| CN | 208295959 U | * | 12/2018 | |
| WO | 2020041111 A1 | | 2/2020 | |

* cited by examiner

*Primary Examiner* — Jacob M Amick
*Assistant Examiner* — Charles J Brauch
(74) *Attorney, Agent, or Firm* — Venable LLP; Elizabeth C. G. Gitlin; Michele V. Frank

(57) ABSTRACT

A fuel nozzle for a combustor includes a fuel body, a primary fuel passage having a primary fuel outlet, and a secondary fuel passage having a secondary fuel outlet, the secondary fuel passage being non-concentric with the primary fuel passage. The primary fuel outlet and the secondary fuel outlet are non-parallel. An axial centerline of the primary fuel outlet is angled with respect to an axial centerline of the primary fuel passage and an axial centerline of the secondary fuel outlet is colinear with an axial centerline of the secondary fuel passage. Also provided is a method of introducing non-concentric, non-parallel fuel flows to a combustor is also provided.

19 Claims, 7 Drawing Sheets

FUEL NOZZLE

GOVERNMENT INTEREST

This invention was made with Government Support under contract number FA8650-15-D-2501. The Government has certain rights in the invention.

TECHNICAL FIELD

The present disclosure relates to a fuel nozzle. More particularly, the present disclosure relates to a fuel nozzle having non-concentric, dual orifices.

BACKGROUND

Current fuel nozzles for combustors are typically concentric, dual orifice nozzles. Such nozzles have a primary fuel passage located concentrically within a secondary fuel passage. The current arrangement is limited in options of distributing the fuel where the fuel is required. Thus, this arrangement may suffer from introducing too much fuel or too little fuel into the primary combustion zone and the secondary combustion zone. This may result in high emissions and low efficiency.

BRIEF SUMMARY

According to an embodiment, a fuel nozzle for a combustor may include a fuel nozzle body, a primary fuel passage having a primary fuel outlet, and a secondary fuel passage having a secondary fuel outlet, the secondary fuel passage being non-concentric with the primary fuel passage. The primary fuel outlet and the secondary fuel outlet may be non-parallel. An axial centerline of the primary fuel outlet may be angled with respect to the fuel nozzle body and an axial centerline of the secondary fuel outlet may be colinear with the fuel nozzle body.

According to an embodiment, a method of introducing fuel into a combustor may include introducing a primary fuel flow through a primary fuel passage in a circumferential direction with respect to the combustor, and introducing a secondary fuel flow through a secondary fuel passage in a radially inward direction with respect to the combustor. The primary fuel flow may be non-concentric with the secondary fuel flow and non-parallel with the secondary fuel flow.

Additional features, advantages, and embodiments of the present disclosure are set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Various embodiments are discussed in detail below. While specific embodiments are discussed, this is done for illustration purposes only. A person skilled in the relevant art will recognize that other components and configurations may be used without departing from the spirit and the scope of the present disclosure.

According to embodiments of the present disclosure, a fuel nozzle may be provided for an ultra-compact combustor or any other gas turbine combustor. The fuel nozzle may include a primary fuel passage and a secondary fuel passage. The primary fuel passage and the secondary fuel passage may be non-concentric, spaced apart passages. The primary fuel passage and the secondary fuel passage may be parallel or non-parallel. The primary fuel passage and the secondary fuel passage may allow for positional control of the fuel flow through the fuel nozzle. The fuel nozzle may include an air assist circuit.

Figure 1B:
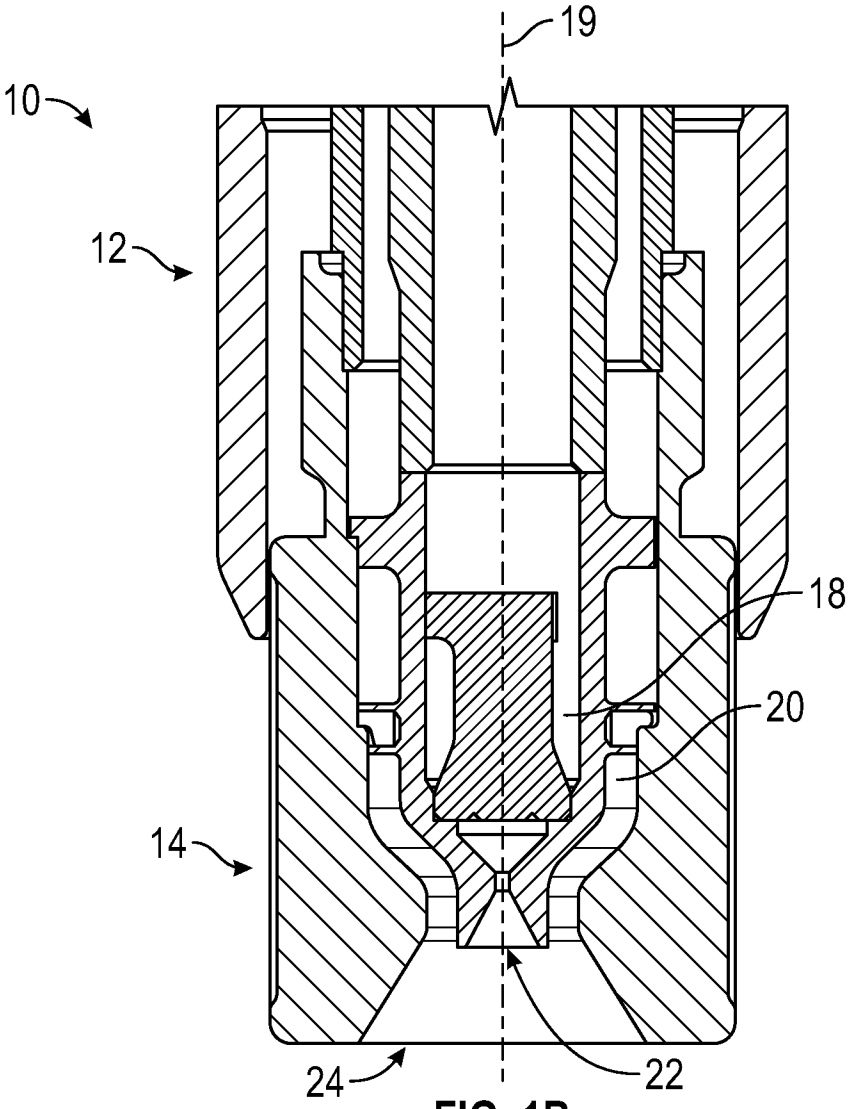
FIG. 1B shows a schematic, sectional view of the fuel nozzle of FIG. 1A, taken along the section line 1B-1B of FIG. 1A, according to an embodiment of the present disclosure.
Figure 1A:
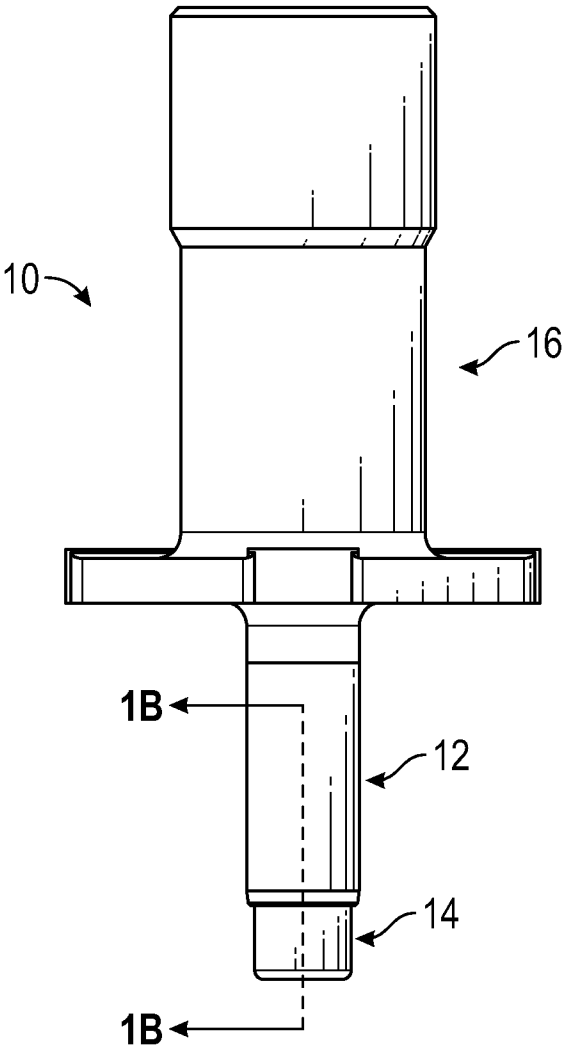
FIG. 1A shows a schematic view of a fuel nozzle, according to an embodiment of the present disclosure.

Referring to FIGS. 1A and 1B, a schematic view of a fuel nozzle 10 is shown. The fuel nozzle 10 may include a lower body 12, a tip 14, and an upper body 16. Referring to FIG.

1B, the fuel nozzle 10 may include a primary fuel passage 18 and a secondary fuel passage 20. The primary fuel passage 18 and the secondary fuel passage 20 may be separate passages. That is, the primary fuel passage 18 and the secondary fuel passage 20 may not be in fluid communication with one another. The primary fuel passage 18 may be located within (e.g., inside) the secondary fuel passage 20. The primary fuel passage 18 and the secondary fuel passage 20 may be concentrically aligned. The primary fuel passage 18 may be located concentrically within the secondary fuel passage 20. For example, the primary fuel passage 18 and the secondary fuel passage 20 may share a common axial centerline 19 such that they are coaxial. Thus, the fuel nozzle 10 may be a concentric, dual orifice fuel nozzle. The primary fuel passage 18 may include a primary fuel outlet 22 and the secondary fuel passage 20 may include a secondary fuel outlet 24. The primary fuel outlet 22 may be located within the secondary fuel passage 20 and behind, or upstream, of the secondary fuel outlet 24.

During operation, fuel flow may be introduced through the primary fuel passage 18 and the secondary fuel passage 20. Injection by the primary fuel passage 18 and the secondary fuel passage 20 is into a similar zone (see, for example, FIG. 6A). The primary fuel passage 18 and the secondary fuel passage 20 are not positionable within the fuel nozzle 10 and, thus, do not allow for positional staging of the fuel flows within the fuel nozzle 10 itself (e.g., the passages themselves are not angled within the fuel nozzle). In some cases, there may be inboard staging and outboard staging (e.g., angular positioning of different nozzles with respect to the outer case 202), such as shown in FIG. 6C. The fuel nozzle 10 thus suffers from introducing too much or too little fuel into the primary combustion zone and the secondary combustion zone. This may result in high emissions and low efficiency.

Figure 2:
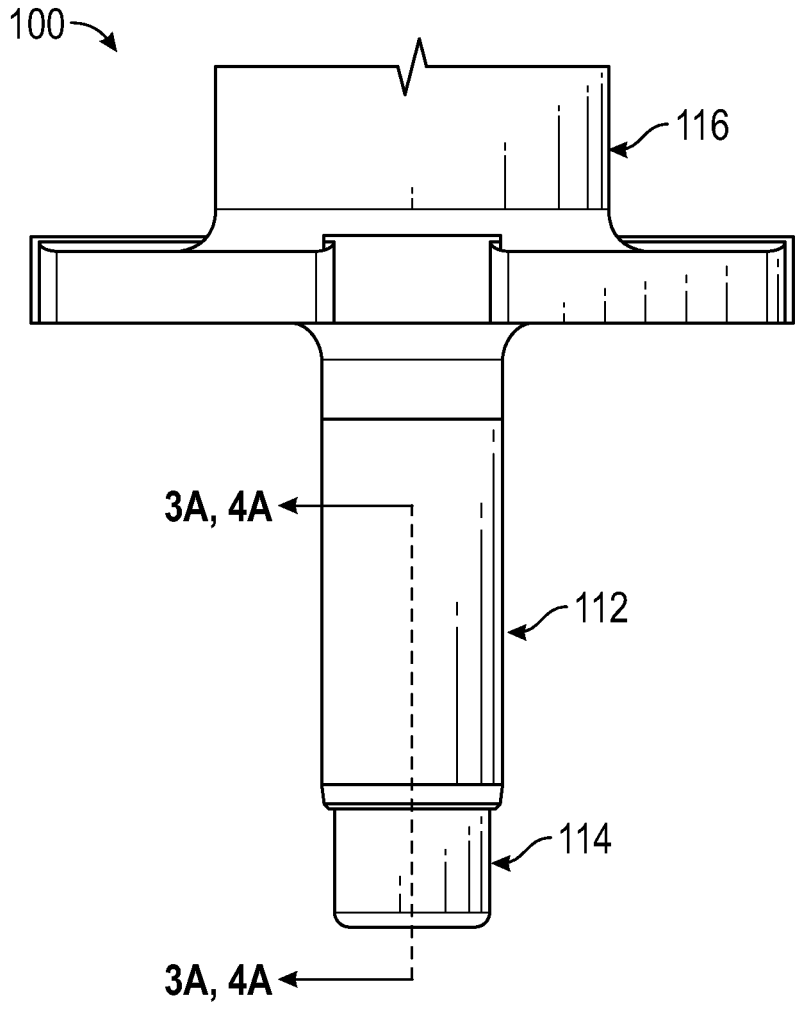
FIG. 2 shows a schematic view of a fuel nozzle, according to an embodiment of the present disclosure.
Figure 3A:
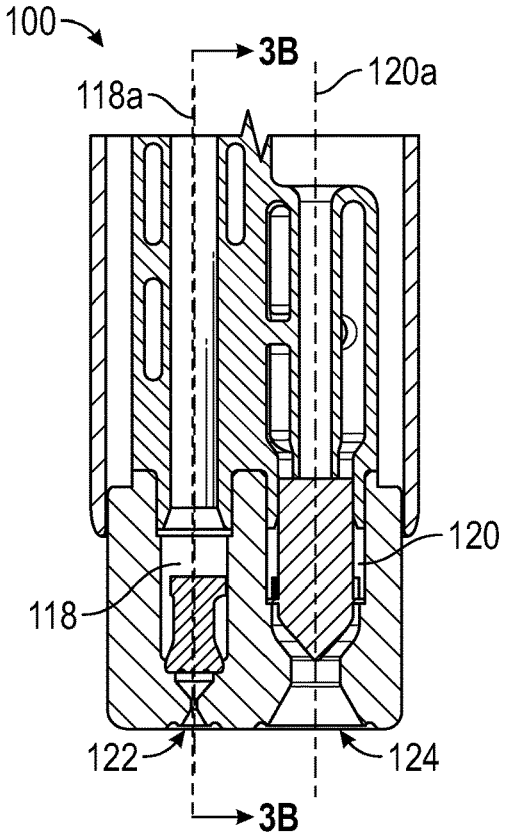
FIG. 3A shows a schematic, sectional view of the fuel nozzle of FIG. 2, taken along the section line 3A-3A of FIG. 2, according to an embodiment of the present disclosure.
Figure 3B:
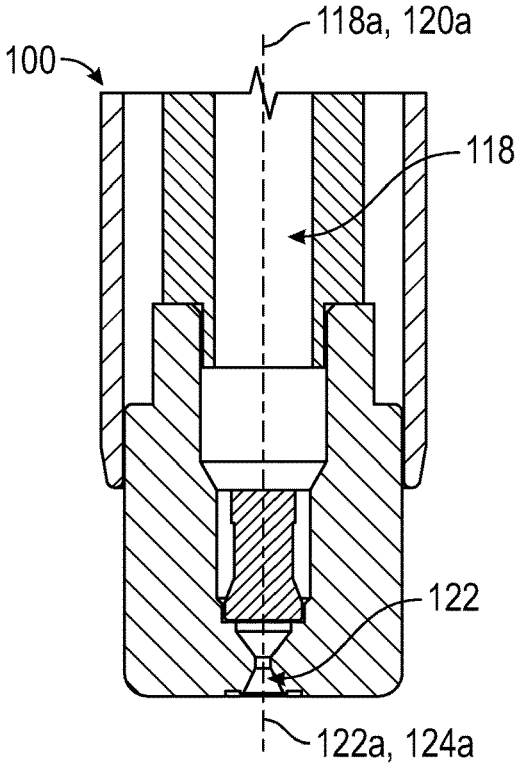
FIG. 3B shows a schematic, sectional view of the fuel nozzle of FIG. 3A, taken along the section line 3B-3B of FIG. 3A, according to an embodiment of the present disclosure.
Figure 3C:
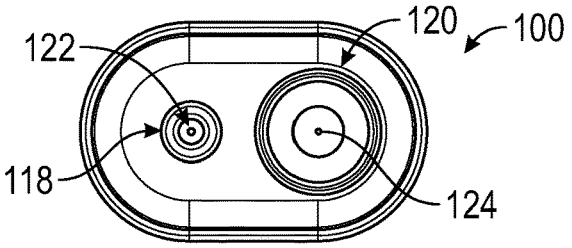
FIG. 3C shows a schematic, bottom view of the fuel nozzle of FIG. 3A, according to an embodiment of the present disclosure.

Referring now to FIGS. 2 to 3C, a schematic view of a fuel nozzle 100 is shown. The fuel nozzle 100 may include a lower body 112, a tip 114, and an upper body 116. Referring to FIGS. 3A to 4B, the fuel nozzle 100 may include a primary fuel passage 118 and a secondary fuel passage 120. The primary fuel passage 118 and the secondary fuel passage 120 may be separate passages. That is, the primary fuel passage 118 and the secondary fuel passage 120 may not be in fluid communication with one another.

As shown in FIGS. 3A to 3C, the primary fuel passage 118 and the secondary fuel passage 120 may be located next to one another (i.e., adjacent to one another). That is, an axial centerline 118*a* of the primary fuel passage 118 and an axial centerline 120*a* of the secondary fuel passage 120 may be spaced from one another (FIG. 3A). The axial centerline 118*a* and the axial centerline 120*a* may be parallel such that the primary fuel passage 118 and the secondary fuel passage 120 are parallel and aligned. The primary fuel passage 118 may include a primary fuel outlet 122 and the secondary fuel passage 120 may include a secondary fuel outlet 124. The primary fuel outlet 122 may be separate from and spaced from the secondary fuel outlet 124. The primary fuel outlet 122 and the secondary fuel outlet 124 may each provide the fuel flow in a spray that is a spray cone, a flat sheet, discrete jets, or any combination thereof. The primary fuel outlet 122 and the secondary fuel outlet 124 may provide the same spray or a different spray. The fuel nozzle 100 may be a dual simplex tip fuel nozzle. The axial centerline 118*a* may extend through the primary fuel outlet 122 such that the primary fuel passage 118 and the primary fuel outlet 122 are aligned and coaxial. The axial centerline 120*a* may extend through the secondary fuel outlet 124 such that the secondary fuel passage 120 and the secondary fuel outlet 124 are aligned and coaxial.

Figure 4A:
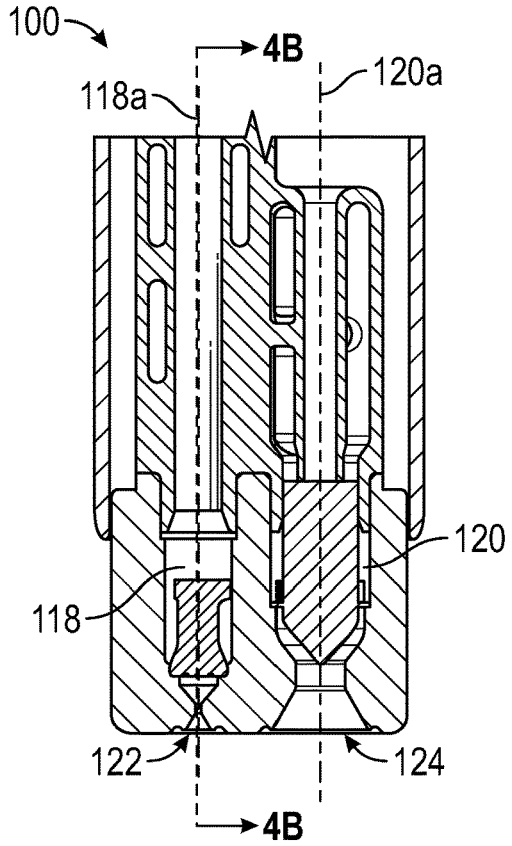
FIG. 4A shows a schematic, sectional view of the fuel nozzle of FIG. 2, taken along the section line 4A-4A of FIG. 2, according to an embodiment of the present disclosure.
Figure 4B:
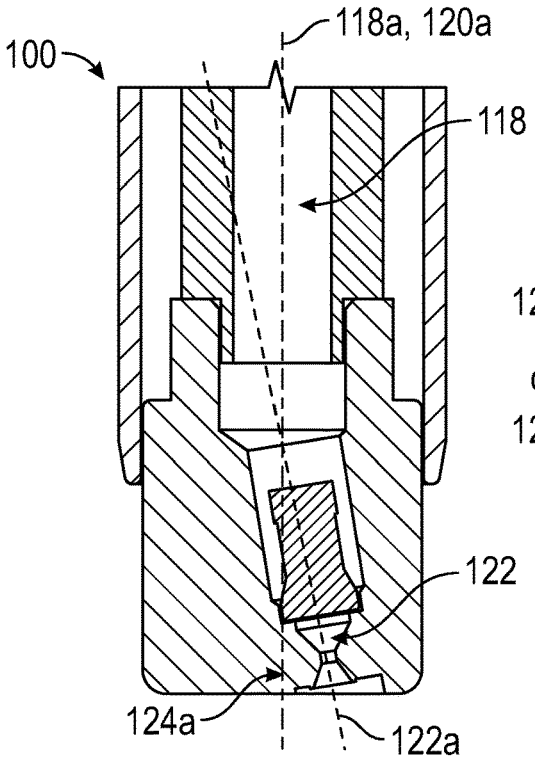
FIG. 4B shows a schematic, sectional view of the fuel nozzle of FIG. 4A, taken along the section line 4B-4B of FIG. 4A, according to an embodiment of the present disclosure.
Figure 4C:
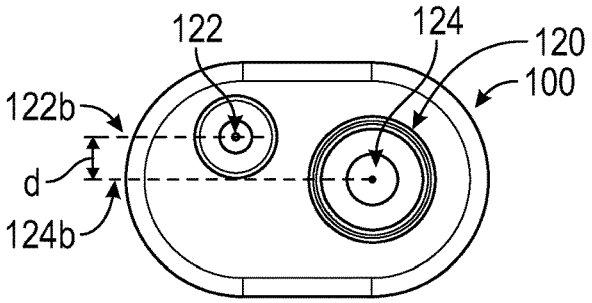
FIG. 4C shows a schematic, bottom view of the fuel nozzle of FIG. 4A, according to an embodiment of the present disclosure.

Referring to FIGS. 4A to 4C, the primary fuel outlet 122 may be angled with respect to the primary fuel passage 118. That is, an axial centerline 122*a* of the primary fuel outlet 122 may be angled with respect to the axial centerline 118*a* of the primary fuel passage 118. As shown in FIG. 4C, due to the angled secondary fuel outlet 124, a transverse axis 122*b* that is normal to the axial centerline 122*a* may be offset a distance d from a transverse axis 124*b* that is normal to an axial centerline 124*a* of the secondary fuel outlet 124. In this manner, the primary fuel outlet 122 may be offset from the secondary fuel outlet 124. This may result in the fuel exiting the fuel nozzle 100 at different locations.

Although shown only for the primary fuel passage 118 and the primary fuel outlet 122, a similar arrangement may be present in the secondary fuel passage 120 such that the axial centerline 124*a* of the secondary fuel outlet 124 is angled with respect to the axial centerline 120*a* of the secondary fuel passage 120. The primary fuel outlet 122 may be angled, the secondary fuel outlet 124 may be angled, or both the primary fuel outlet 122 and the secondary fuel outlet 124 may be angled with respect to a longitudinal axis of the fuel nozzle 100 or with respect to the other of the fuel outlets or fuel passages. In some cases, the fuel outlets may be angled in the same direction, in different directions, in opposing directions, in the same direction but at different angles, in different directions and at different angles, or any combination thereof. Although FIG. 4B shows the primary fuel outlet 122 angled toward the right in FIG. 4B (e.g., into the page or out of the page as viewed in FIG. 4A), the primary fuel outlet 122 may be angled to the left, may be angled inward or outward (e.g., to the left or to the right as viewed in FIG. 4A), and/or may be angled to different degrees than shown. Similar modifications may be made to the secondary fuel outlet 124.

Accordingly, the primary fuel outlet 122 and the secondary fuel outlet 124 may be parallel (FIG. 3B) or non-parallel (FIG. 4B). In some cases, the angle of the primary fuel outlet 122 and/or the secondary fuel outlet 124 may be selected or predetermined to achieve flow into a particular zone of the combustor. For example, the primary fuel outlet 122 may be angled toward the circumference and the secondary fuel outlet 124 may be angled toward the radial center. The outlets may be angled with respect to a centerline of the respective fuel passage. The primary fuel outlet 122 and the secondary fuel outlet 124 may be spaced apart circumferentially, axially, or both circumferentially and axially. This may allow for each of the fuel flows through the primary fuel passage 118 and the secondary fuel passage 120 to be spaced apart circumferentially, axially, or both circumferentially and axially. The ability to orient the primary fuel outlet 122 and the secondary fuel outlet 124 may allow for directing the primary fuel flow and the secondary fuel flow into the desired direction to provide mixing of the fuel and air flows. For example, referring to FIG. 7B, the primary fuel outlet 122 (FIG. 4A) may be angled such that the primary fuel flow A is directed toward the circumference of the outer case 202 (e.g., angled more circumferentially than is the secondary fuel outlet 124). In the same example of FIG. 7B, the secondary fuel outlet 124 (FIG. 4A) may be angled such that the secondary fuel flow B is directed toward the radial center of the combustor (e.g., angled more radially than the primary fuel outlet 122).

Although depicted in FIGS. 3A to 3C and 4A to 4C as having a parallel axial centerline 118*a* and an axial centerline 120*a*, the primary fuel passage 118 and the secondary fuel passage 120 may have an axial centerline 118*a* and an axial centerline 120*a* that may be non-parallel. That is, the axial centerline 118*a* and the axial centerline 120*a* may be angled with respect to one another and/or with respect to the fuel nozzle 100. In some embodiments, the axial centerline 118*a* of the primary fuel passage 118 may be angled circumferentially and the secondary fuel passage 120 may be angled radially resulting in the passages and the outlets being angled as well.

With continued reference to FIGS. 4A to 4C and FIG. 7B, the primary fuel outlet 122 may be tilted or angled with respect to the axial centerline 118*a* of the primary fuel passage 118. The secondary fuel outlet 124 may be parallel with a longitudinal axis of the body of the fuel nozzle 100. The angle of the primary fuel outlet 122 with respect to the primary fuel passage 118 may be zero degrees to forty-five degrees or any value or range therein. Although described as the outlets being angled or non-parallel, in some embodiments, the primary fuel passage 118 and secondary fuel passage 120 may be angled or non-parallel (either in addition to the fuel outlets or instead of the fuel outlets). For example, the primary fuel passage 118 may be angled with respect to the nozzle body and the secondary fuel passage 120 may be aligned parallel to the longitudinal axis of the nozzle body such that the primary fuel passage 118 and secondary fuel passage 120 are non-parallel.

Figure 5:
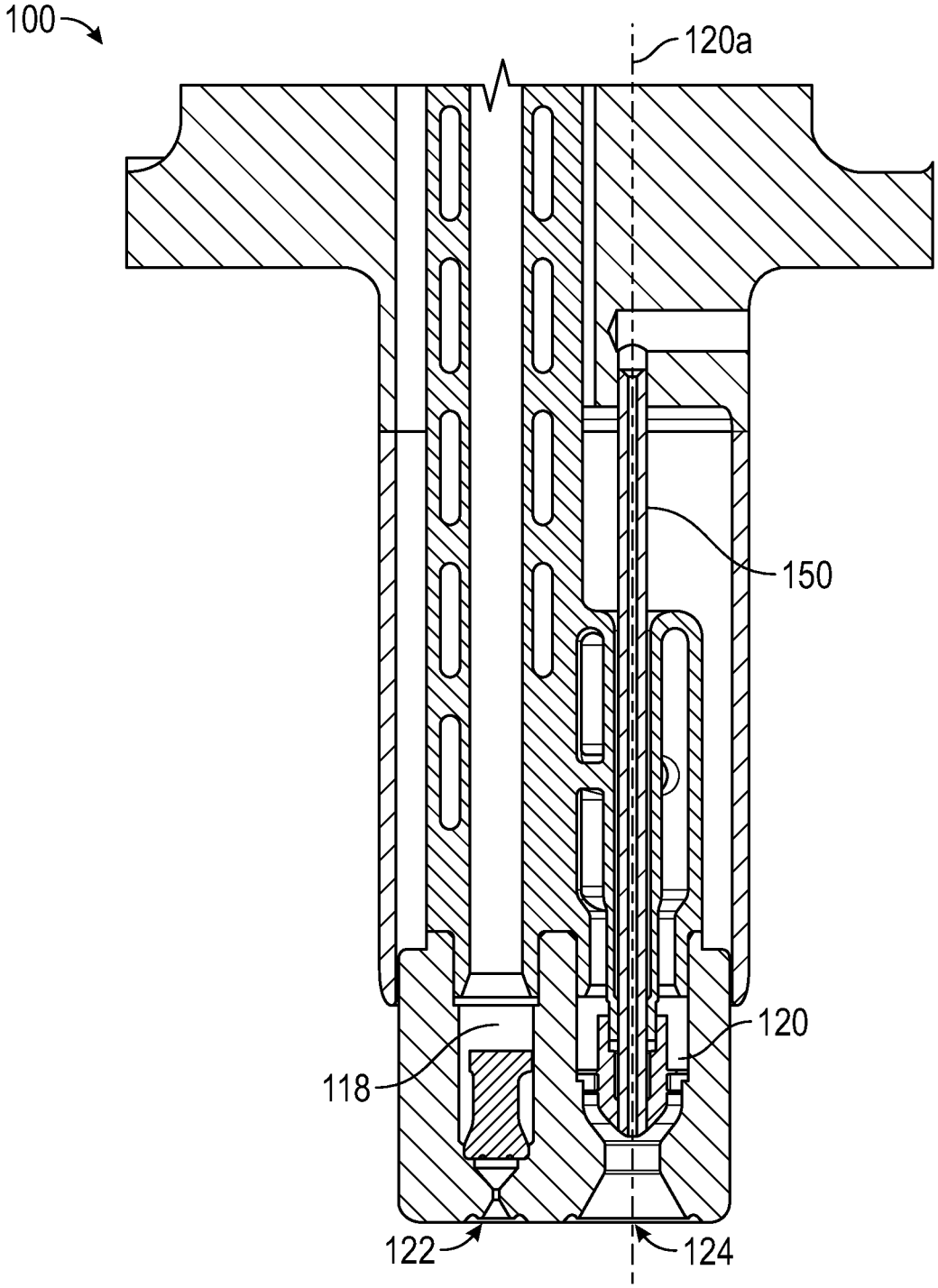
FIG. 5 shows a schematic, cross-sectional view of a fuel nozzle, taken along a similar section 3A-3A of FIG. 2, according to an embodiment of the present disclosure.

Referring to FIG. 5, in some embodiments, the fuel nozzle 100 may include an air assist 150. The air assist 150 may have a centerline that is coaxial with the axial centerline 120*a* of the secondary fuel passage 120. The air assist 150 may be used in partial power conditions. That is, when the secondary fuel passage 120 begins to introduce fuel, the air assist 150 may assist in atomizing the fuel flow with a very little amount of air. In practice, the fuel nozzle 100 will be activated to inject or to introduce fuel flow through the primary fuel passage 118 during start up at the engine or initiation of the engine and, then, during operation, the secondary fuel passage 120 may introduce fuel flow. Although described with respect to the secondary fuel passage 120, an air assist may be provided in the primary fuel passage 118, either additionally or alternatively, to the air assist 150 in the secondary fuel passage 120.

Figure 6B:
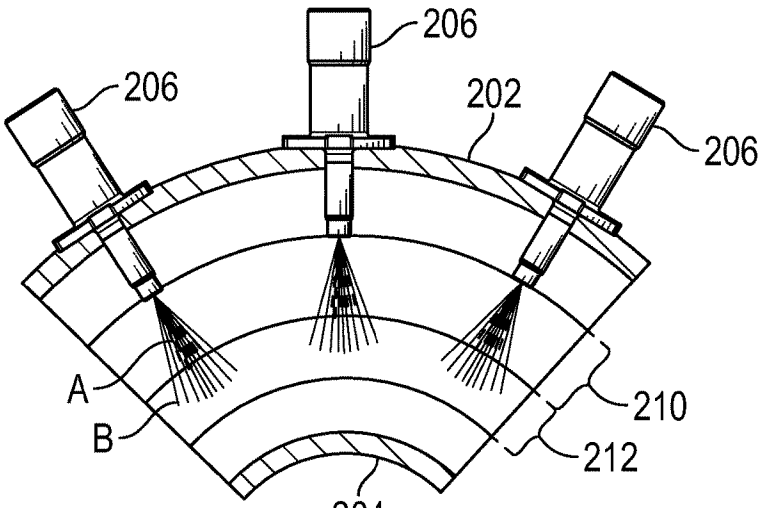
FIG. 6B shows a schematic view of a combustor having a fuel nozzle, according to an embodiment of the present disclosure.
Figure 6C:
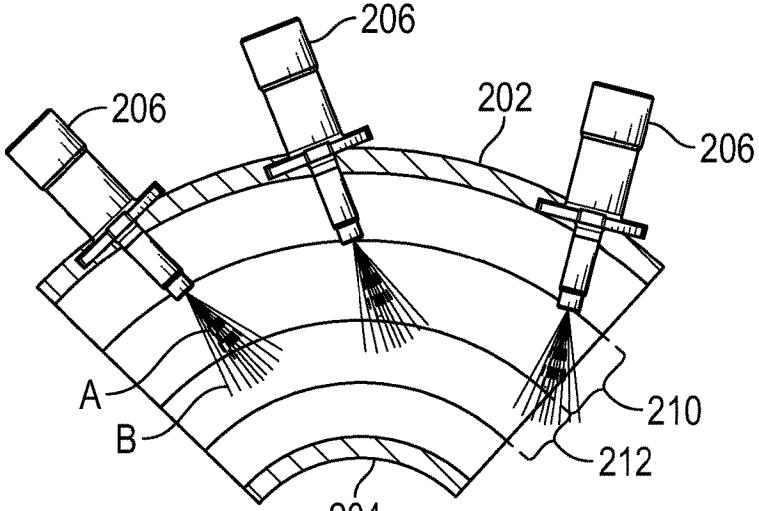
FIG. 6C shows a schematic view of a combustor having a fuel nozzle, according to an embodiment of the present disclosure.
Figure 6A:
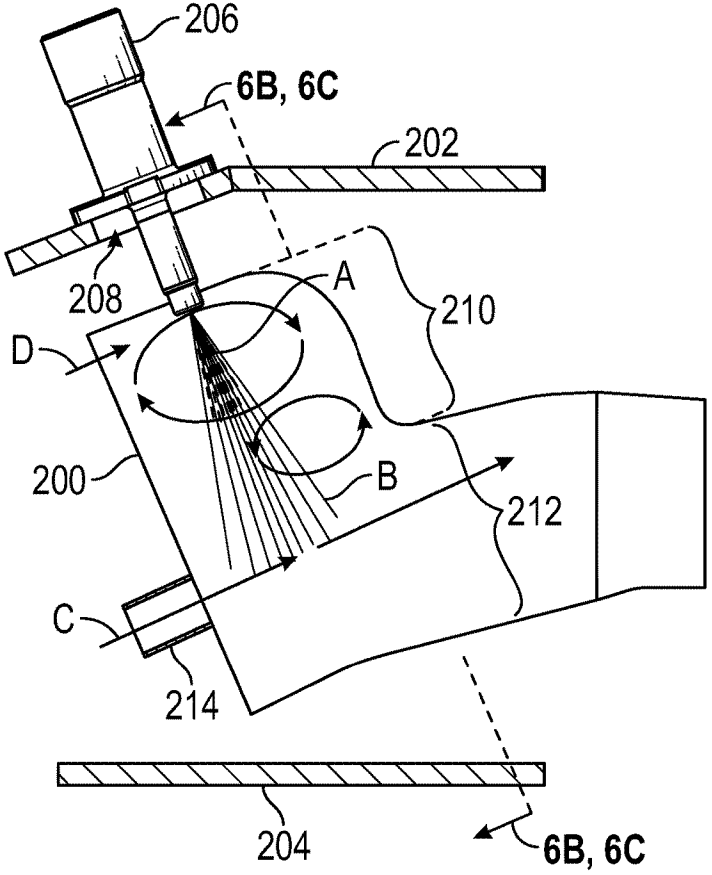
FIG. 6A shows a schematic view of a combustor having a fuel nozzle, according to an embodiment of the present disclosure.

FIGS. 6A to 6C show a combustor 200 located within an outer case 202 and an inner case 204. Within the combustor 200 may be a primary zone 210 and a secondary zone 212. One or more fuel nozzles 206 may be placed in one or more openings 208 of the outer case 202. The fuel nozzles 206 may be the fuel nozzle 10 of FIGS. 1A and 1B. The fuel nozzles 206 may introduce fuel into an interior of the combustor 200. The fuel nozzle 206 may include concentric, coaxial primary, and secondary fuel passages (not visible) such as described with respect to FIG. 1. The primary fuel passage may introduce a primary fuel flow A to the interior of the combustor 200. The secondary fuel passage may introduce a secondary fuel flow B to the interior of the combustor 200. As shown in FIG. 6A, the primary fuel flow A and the secondary fuel flow B may interact with an air flow C from a chute 214 and an air flow D from a compressor (not visible).

FIG. 6B shows the combustor 200 taken along the section line 6B-6B of FIG. 6A with the primary fuel flow A and the secondary fuel flow B directed radially inward of the combustor. Such an arrangement may push too much fuel out of the primary zone 210 and into the secondary zone 212. This may result in an air-fuel ratio that is too lean for combustion. FIG. 6C shows the combustor 200 taken along the section line 6C-6C of FIG. 6A with the entire fuel nozzle 206 circumferentially angled such that both the primary fuel flow A and the secondary fuel flow B are circumferentially angled. Such an arrangement may introduce too much fuel into the primary zone 210. This may result in an air-fuel ratio that is too rich for combustion. In the arrangement of FIGS. 6A to 6C, the primary fuel flow A and the secondary fuel flow B are introduced simultaneously at the same axial plane and the same circumferential plane.

As can be seen from FIGS. 6A to 6C, when a concentric, dual orifice fuel nozzle is employed, fuel may be injected axially, radially, or circumferentially. Injecting fuel mostly axially in the combustor may eventually result in the fuel reaching the opposite side of the cavity (e.g., without mixing with air) and may not allow proper mixing within the secondary zone. To properly provide enough fuel to the secondary zone, fuel may be injected mostly radially inboard, but this may result in more difficult propagation of fuel around the combustor leading to an overly lean primary zone. Injecting fuel mostly circumferentially may assist propagation and benefit propagation, but results in difficulty in mixing in the secondary zone and, thus, can over-richen the primary zone, leading to efficiency and smoke issues.

Figure 7B:
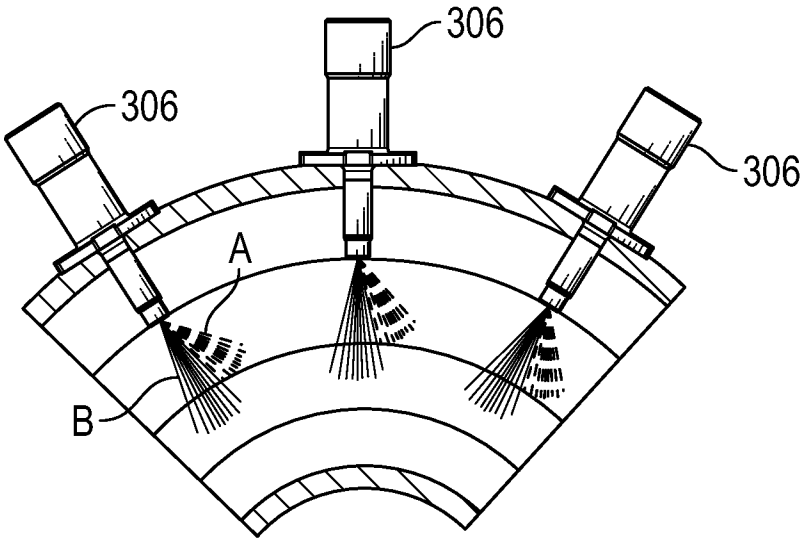
FIG. 7B shows a schematic view of a combustor having a fuel nozzle, according to an embodiment of the present disclosure.
Figure 7A:
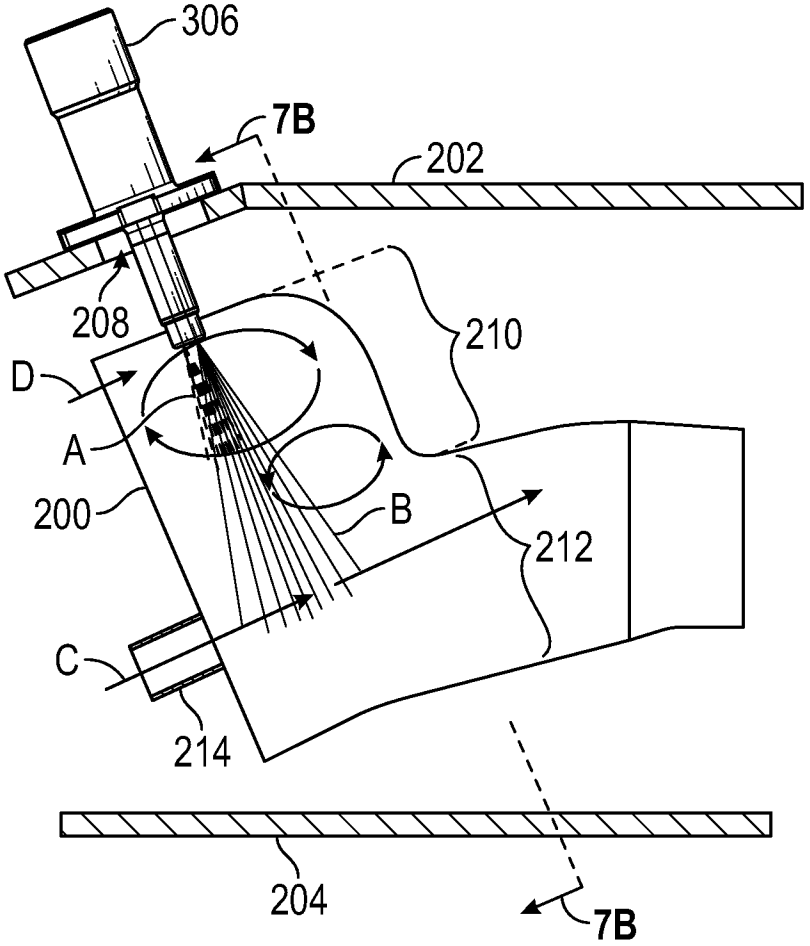
FIG. 7A shows a schematic view of a combustor having a fuel nozzle, according to an embodiment of the present disclosure.

As shown in FIGS. 7A and 7B, the combustor 200 may include one or more fuel nozzles 306. The fuel nozzles 306 may be the fuel nozzle 100 shown in FIGS. 2 to 5. The fuel nozzles 306 may include primary fuel flow A and secondary fuel flow B, provided by the primary fuel passage 118 and the secondary fuel passage 120 of FIG. 3A or FIG. 4A. The primary fuel flow A and the secondary fuel flow B may be arranged with different centerline angles. For example, the primary fuel flow A may be angled more circumferentially for improved propagation and the secondary fuel flow B may be angled more radially to prevent over-richening the vortex (in the primary zone). The angling may be achieved by angling the outlets (e.g., 122 and 124 of FIG. 4A) of the nozzle. Alternatively, or additionally, the fuel passages may be angled.

Referring now to FIG. 7B, the primary fuel flow A (and, thus, the primary fuel outlet 122) may be angled more circumferentially, that is, angled such that the flow is directed closer to the circumference of the outer case 202 (FIG. 7A), while the secondary fuel flow B (and, thus, the secondary fuel outlet 124) may be angled more radially, that is, angled such that the flow is directed toward the radial center of the combustor 200 (FIG. 7A). Angling the primary fuel flow A circumferentially may improve flame propagation in the vortex cavity. Angling the secondary fuel flow B radially inward may prevent the vortex from becoming overly rich, reducing the risk of high smoke and poor efficiency. The angling of the primary fuel flow A and the secondary fuel flow B may be such that the proper amount of fuel is introduced into the primary zone and into the secondary zone to achieve desired combustion with improved efficiency.

As shown in FIGS. 7A and 7B, the nozzles and, thus, the fuel flows may be arranged to achieve a desired mixing of the fuel and the air to improve engine efficiency and reduce emissions, as compared to the combustor 200 shown in FIGS. 6A to 6B, and having the fuel nozzle 10.

Accordingly, the fuel nozzle of the present disclosure may be a dual simplex orifice nozzle. The fuel nozzle may have primary sprays and secondary sprays that are non-concentric allowing spacing in the circumferential direction, axial direction, or both the circumferential and axial direction. The fuel nozzle of the present disclosure may be arranged to have a centerline of two simplex orifices that are non-parallel, in which a primary spray is angled more circumferentially and a secondary spray is angled more radially. Any of the aforementioned fuel nozzles may be arranged with an air assist circuit.

The fuel nozzles of the present disclosure may allow for independent control of fuel sprays, such as independent direction control of the primary fuel flow and the secondary fuel flow, also referred to as the primary spray and the secondary spray. The fuel nozzles of the present disclosure may allow for greater distribution and greater mixing of fuel with air, as compared to a concentric, dual orifice fuel nozzle. The fuel nozzles allow for a wider distribution of fuel (as compared to a concentric, dual orifice fuel nozzle) and, thus, increased mixing rate with air for improvement in combustion efficiency.

The fuel nozzle of the present disclosure may allow for the primary spray to be angled more circumferentially to improve flame propagation in a vortex cavity. The secondary spray may be angled more radially inward to prevent a vortex from becoming overly rich. This may reduce the risk of high smoke and poor efficiency and may provide for improved efficiency of the engine with lowered emissions The fuel nozzle of the present disclosure may provide a fuel nozzle that is not wrapped in the swirler, thus, allowing separating of the primary flows and the secondary flows. The fuel nozzle of the present disclosure allows increased control of fuel distribution in the combustor. The fuel nozzle may allow for focusing the primary fuel on the vortex primary zone and the secondary fuel flow on the secondary combustor zone. This may improve combustion efficiency and reduce smoke. The fuel nozzle may allow for a pure primary pressure atomization. The fuel nozzle may allow for air assist on the secondary fuel flow. The air assist circuit may be beneficially operated above starting conditions. A large differential pressure on the air circuit may atomize very low fuel flows in the secondary fuel passage with a very small amount of air.

Further aspects of the present disclosure are provided by the subject matter of the following clauses.

A fuel nozzle for a combustor. The fuel nozzle includes a fuel nozzle body, a primary fuel passage having a primary fuel outlet, and a secondary fuel passage having a secondary fuel outlet, the secondary fuel passage being non-concentric with the primary fuel passage, wherein the primary fuel outlet and the secondary fuel outlet are non-parallel, and wherein an axial centerline of the primary fuel outlet is angled with respect to the fuel nozzle body and an axial centerline of the secondary fuel outlet is colinear with the fuel nozzle body.

The fuel nozzle of the preceding clause, wherein the primary fuel outlet is angled circumferentially.

The fuel nozzle of any preceding clause, wherein the axial centerline of the primary fuel outlet is angled between five degrees and forty-five degrees.

The fuel nozzle of any preceding clause, wherein an axial position of the primary fuel outlet and a circumferential position of the primary fuel outlet are independently controlled with respect to an axial position of the secondary fuel outlet and a circumferential position of the secondary fuel outlet.

The fuel nozzle of any preceding clause, further comprising an air assist circuit adjacent to the secondary fuel passage, the primary fuel passage, or both the secondary fuel passage and the primary fuel passage.

The fuel nozzle of any preceding clause, wherein the primary fuel outlet is a spray cone, a flat spray, or a discrete jet and the secondary fuel outlet is a spray cone, a flat spray, or a discrete jet.

The fuel nozzle of any preceding clause, wherein the axial centerline of the primary fuel outlet is angled with respect to an axial centerline of the primary fuel passage and the axial centerline of the secondary fuel outlet is angled with an axial centerline of the secondary fuel passage.

The fuel nozzle of any preceding clause, wherein the axial centerline of the primary fuel outlet is colinear with an axial centerline of the primary fuel passage and the axial centerline of the secondary fuel outlet is colinear with an axial centerline of the secondary fuel passage.

The fuel nozzle of any preceding clause, wherein the primary fuel outlet is a single orifice and the only outlet of the primary fuel passage, and wherein the secondary fuel outlet is a single orifice and the only outlet of the secondary fuel passage.

A method of introducing fuel into a combustor. The method includes introducing a primary fuel flow through a primary fuel passage in a circumferential direction with respect to the combustor, and introducing a secondary fuel flow through a secondary fuel passage in a radially inward direction with respect to the combustor, wherein the primary fuel flow is non-concentric with the secondary fuel flow and non-parallel with the secondary fuel flow.

The method of any preceding clause, further comprising introducing the primary fuel flow as a spray cone, a flat spray, or a discrete jet and introducing the secondary fuel flow as a spray cone, a flat spray, or a discrete jet.

The method of any preceding clause, further comprising an air assist circuit for providing an air flow to the primary fuel flow, the secondary fuel flow, or both the primary fuel flow and the secondary fuel flow.

The method of any preceding clause, further comprising atomizing the secondary fuel flow.

The method of any preceding clause, further comprising introducing the primary fuel flow to a primary zone of the combustor and introducing the secondary fuel flow to a secondary zone of the combustor.

The method of any preceding clause, wherein the primary fuel passage comprises a primary fuel outlet and the secondary fuel passage comprises a secondary fuel outlet, the primary fuel outlet being the only outlet of the primary fuel passage and the secondary fuel outlet being the only outlet of the secondary fuel passage.

The method of the preceding clause, wherein introducing the primary fuel flow comprises introducing the primary fuel flow through the primary fuel passage and a primary fuel outlet.

The method of any preceding clause, further comprising angling the primary fuel outlet with respect to the primary fuel passage.

The method of any preceding clause, wherein the angling comprises an axial centerline of the primary fuel outlet angled between five degrees and forty-five degrees.

The method of any preceding clause, wherein introducing the secondary fuel flow comprises introducing the secondary fuel flow through the secondary fuel passage and a secondary fuel outlet.

The method of any preceding clause, further comprising independently controlling an axial position of the primary fuel outlet and a circumferential position of the primary fuel outlet with respect to an axial position of the secondary fuel outlet and a circumferential position of the secondary fuel outlet.

Although the foregoing description is directed to the preferred embodiments, it is noted that other variations and modifications will be apparent to those skilled in the art, and may be made without departing from the spirit or scope of the disclosure Moreover, features described in connection with one embodiment may be used in conjunction with other embodiments, even if not explicitly stated above.

The invention claimed is:

1. A fuel nozzle for a combustor, the fuel nozzle comprising:

a fuel nozzle body;

a primary fuel passage having a primary fuel outlet; and a secondary fuel passage having a secondary fuel outlet, the secondary fuel passage being non-concentric with the primary fuel passage, wherein the primary fuel outlet and the secondary fuel outlet are non-parallel, wherein an axial centerline of the primary fuel outlet is angled with respect to the fuel nozzle body and an axial centerline of the secondary fuel outlet is colinear with the fuel nozzle body, and wherein the primary fuel outlet is a single orifice and the only outlet of the primary fuel passage, and the secondary fuel outlet is a single orifice and the only outlet of the secondary fuel passage.

2. The fuel nozzle of claim 1, wherein the primary fuel outlet is angled circumferentially.

3. The fuel nozzle of claim 1, wherein the axial centerline of the primary fuel outlet is angled between five degrees and forty-five degrees.

4. The fuel nozzle of claim 1, wherein an axial position of the primary fuel outlet and a circumferential position of the primary fuel outlet are independently controlled with respect to an axial position of the secondary fuel outlet and a circumferential position of the secondary fuel outlet.

5. The fuel nozzle of claim 1, further comprising an air assist circuit adjacent to the secondary fuel passage, the primary fuel passage, or both the secondary fuel passage and the primary fuel passage.

6. The fuel nozzle of claim 1, wherein the primary fuel outlet is a spray cone, a flat spray, or a discrete jet, and the secondary fuel outlet is a spray cone, a flat spray, or a discrete jet.

7. The fuel nozzle of claim 1, wherein the axial centerline of the primary fuel outlet is angled with respect to an axial centerline of the primary fuel passage and the axial centerline of the secondary fuel outlet is angled with an axial centerline of the secondary fuel passage.

8. The fuel nozzle of claim 1, wherein the axial centerline of the primary fuel outlet is colinear with an axial centerline of the primary fuel passage and the axial centerline of the secondary fuel outlet is colinear with an axial centerline of the secondary fuel passage.

9. A method of introducing fuel into a combustor, the method comprising:

introducing a primary fuel flow through a primary fuel passage in a circumferential direction with respect to the combustor; and introducing a secondary fuel flow through a secondary fuel passage in a radially inward direction with respect to the combustor, wherein the primary fuel flow is non-concentric with the secondary fuel flow and non-parallel with the secondary fuel flow, and wherein the primary fuel flow and the secondary fuel flow are introduced from a single fuel nozzle.

10. The method of claim 9, further comprising introducing the primary fuel flow as a spray cone, a flat spray, or a discrete jet and introducing the secondary fuel flow as a spray cone, a flat spray, or a discrete jet.

11. The method of claim 9, further comprising an air assist circuit for providing an air flow to the primary fuel flow, the secondary fuel flow, or both the primary fuel flow and the secondary fuel flow.

12. The method of claim 9, further comprising atomizing the secondary fuel flow.

13. The method of claim 9, further comprising introducing the primary fuel flow to a primary zone of the combustor and introducing the secondary fuel flow to a secondary zone of the combustor.

14. The method of claim 9, wherein the primary fuel passage comprises a primary fuel outlet and the secondary fuel passage comprises a secondary fuel outlet, the primary fuel outlet being the only outlet of the primary fuel passage and the secondary fuel outlet being the only outlet of the secondary fuel passage.

15. The method of claim 9, wherein introducing the primary fuel flow comprises introducing the primary fuel flow through the primary fuel passage and a primary fuel outlet.

16. The method of claim 15, further comprising angling the primary fuel outlet with respect to the primary fuel passage.

17. The method of claim 16, wherein the angling comprises an axial centerline of the primary fuel outlet angled between five degrees and forty-five degrees.

18. The method of claim 15, wherein introducing the secondary fuel flow comprises introducing the secondary fuel flow through the secondary fuel passage and a secondary fuel outlet.

19. The method of claim 18, further comprising independently controlling an axial position of the primary fuel outlet and a circumferential position of the primary fuel outlet, with respect to an axial position of the secondary fuel outlet and a circumferential position of the secondary fuel outlet.

* * * * *